US009200774B2

(12) United States Patent
Schaefer et al.

(10) Patent No.: US 9,200,774 B2
(45) Date of Patent: Dec. 1, 2015

(54) VEHICLE REFLECTOR ASSEMBLY WITH CIRCUIT BOARD RETENTION PLATE

(75) Inventors: Roger Schaefer, Columbus, IN (US); Timothy Belt, Madison, IN (US)

(73) Assignee: Valeo North America, Inc., Seymour, IN (US)

( * ) Notice: Subject to any disclaimer, the term of this patent is extended or adjusted under 35 U.S.C. 154(b) by 218 days.

(21) Appl. No.: 13/568,748

(22) Filed: Aug. 7, 2012

(65) Prior Publication Data

US 2014/0043806 A1 Feb. 13, 2014

(51) Int. Cl.

| | |
|---|---|
| ***F21V 1/00*** | (2006.01) |
| ***F21S 8/10*** | (2006.01) |
| *F21V 17/10* | (2006.01) |

(Continued)

(52) U.S. Cl.

CPC ..... *F21S 48/211* (2013.01); *F21S 48/215* (2013.01); *F21S 48/1104* (2013.01); *F21S 48/1109* (2013.01); *F21S 48/1305* (2013.01); *F21S 48/232* (2013.01); *F21V 17/005* (2013.01); *F21V 17/104* (2013.01); *F21V 19/003* (2013.01); *F21V 19/0035* (2013.01); *Y10T 29/49826* (2015.01)

(58) Field of Classification Search

CPC ... F21S 48/211; F21S 48/212; F21S 48/1104; F21S 48/1109; F21S 48/115; F21S 48/13; F21S 48/1305; F21S 48/215; F21S 48/23; F21S 48/232; F21S 48/1122; F21S 48/1311; F21S 48/1323; F21S 48/1341; F21S 48/1347; F21S 48/1352; F21S 48/1358; F21S 48/1364; F21S 48/137; B60Q 1/0483; B60Q 1/2696; F21V 17/14; F21V 17/104; F21V 17/005; F21V 19/003; F21V 19/0035; F21V 19/0045; F21V 17/06

USPC ..... 362/507, 538, 516, 548, 549, 545

See application file for complete search history.

(56) References Cited

U.S. PATENT DOCUMENTS

| | | | | |
|---|---|---|---|---|
| 6,015,223 | A * | 1/2000 | Kidd et al. | 362/503 |
| 6,095,663 | A * | 8/2000 | Pond et al. | 362/247 |

(Continued)

FOREIGN PATENT DOCUMENTS

| | | | |
|---|---|---|---|
| DE | 102006002322 | A1 * | 12/2007 |
| EP | 2481635 | A1 * | 8/2012 |

OTHER PUBLICATIONS

Roemer, Andreas, Lighting unit e.g. elongated auxiliary brake light, for vehicle, has lighting element positioned on carrier module, and attaching unit provided such that attachment module is connected with conducting element, module and/or side wall, Dec. 27, 2007, English translation.*

*Primary Examiner* — Mary McManmon
*Assistant Examiner* — James Endo
(74) *Attorney, Agent, or Firm* — Jacox, Meckstroth & Jenkins

(57) ABSTRACT

A lamp reflector assembly (10) includes a lamp reflector (100) and circuit board holder plate (300). The lamp reflector (100) and the circuit board holder plate (300) each include guide ribs (115, 315) to hold a lamp circuit board (200) in place in the reflector assembly (10). The board holder plate (300) provides X, Y, Z location of the circuit board (200) as well as visual position verification of the circuit board (200) held in the reflector assembly (10). Finger tabs (210) protruding from the circuit board (200) through slots (320) in the board holder plate (300) permit repositioning the circuit board (200) so that the lamp circuit board (200), the board holder plate (300), and the lamp reflector (100) are properly positioned relative to each other prior to securing the board holder plate (300) to the reflector (100).

18 Claims, 5 Drawing Sheets

(51) Int. Cl.
*F21V 19/00* (2006.01)
*F21V 17/00* (2006.01)

(56) References Cited

U.S. PATENT DOCUMENTS

| | | | | |
|---|---|---|---|---|
| 6,500,018 | B1 | 12/2002 | Pfaffenberger et al. | |
| 6,561,689 | B1 * | 5/2003 | Kidd et al. | 362/541 |
| 6,641,284 | B2 * | 11/2003 | Stopa et al. | 362/240 |
| 6,902,308 | B2 * | 6/2005 | Love | 362/545 |
| 6,939,029 | B1 * | 9/2005 | Stahel et al. | 362/545 |
| 7,055,996 | B2 * | 6/2006 | Pond et al. | 362/498 |
| 7,245,203 | B2 * | 7/2007 | Stephens et al. | 340/425.5 |
| 7,290,911 | B2 * | 11/2007 | Tsukamoto et al. | 362/543 |
| 7,407,307 | B2 * | 8/2008 | Hiratsuka | 362/304 |
| 7,414,861 | B2 | 8/2008 | Tsai | |
| 7,841,742 | B2 | 11/2010 | Freeman et al. | |
| 7,845,829 | B2 | 12/2010 | Shaner | |
| 7,914,162 | B1 * | 3/2011 | Huang | 362/92 |
| 2004/0076004 | A1 * | 4/2004 | Smith, Jr. | 362/237 |
| 2005/0068723 | A1 * | 3/2005 | Squillante | 361/687 |
| 2006/0028830 | A1 * | 2/2006 | Tsai | 362/509 |
| 2008/0031004 | A1 * | 2/2008 | Chu | 362/545 |
| 2008/0180972 | A1 * | 7/2008 | Sakamoto et al. | 362/613 |
| 2009/0296418 | A1 * | 12/2009 | Luo et al. | 362/516 |
| 2010/0142217 | A1 * | 6/2010 | Gerhard et al. | 362/516 |
| 2010/0214768 | A1 * | 8/2010 | Dixon et al. | 362/119 |
| 2010/0271816 | A1 * | 10/2010 | Ozeki et al. | 362/217.05 |
| 2010/0302777 | A1 * | 12/2010 | Knoll et al. | 362/235 |
| 2011/0007517 | A1 * | 1/2011 | Chien | 362/497 |
| 2011/0058387 | A1 * | 3/2011 | Matsunaga et al. | 362/547 |

* cited by examiner

VEHICLE REFLECTOR ASSEMBLY WITH CIRCUIT BOARD RETENTION PLATE

FIELD

The present disclosure relates to lamp reflectors holding one or more lamp circuit boards. Lamp reflectors are used in motor vehicles, but are not limited thereto.

ACKNOWLEDGED PRIOR ART

In a prior art tail lamp vehicle reflector, the lamp FR4 circuit boards were wedged into tee slots located on the non-reflective rear side of the reflector. The reflector rear surface had datum surfaces to locate the circuit board. LEDs on the circuit board were in register with apertures on the reflector. Once the lamp circuit boards are inserted into the tee slots, the lamp circuit boards are directly fastened, e.g., screwed, to the reflector.

Other arrangements to hold circuit boards are known in U.S. Pat. No. 7,841,742 (Freeman); U.S. Pat. No. 7,845,829 (Shaner); U.S. Pat. No. 7,414,861 (Tsai) and U.S. Pat. No. 6,500,018 (Pfaffenberger).

BRIEF SUMMARY OF DISCLOSED EMBODIMENTS

In one embodiment, a lamp reflector assembly includes a lamp reflector and a lamp circuit board holder plate that holds a lamp circuit board, accurately positioned, to the reflector, as well as a related assembly method.

Such embodiments improve visual position verification of the lamp circuit board and more accurate positioning of the lamp circuit board with respect to the reflector.

The reflector includes one or more first guide ribs so that an operator (which may be a robot) can place first the lamp circuit board into the reflector. The board holder plate includes one or more second guide ribs which force the placed lamp circuit board into a design X, Y, Z position with respect to the reflector when the board holder plate is loaded/mounted to the reflector.

With the board holder plate loaded/mounted on the reflector, finger slots allow position verification of the lamp circuit board with respect to the thus-far assembled reflector assembly. The finger slots are located on the board holder plate; a portion of the circuit board protrudes through the finger slots and is accessible to operator manipulation. Upon successful position verification, a securing element secures the board holder plate to the reflector with the lamp circuit board held in the design position. Thereby, the assembly accommodates visual position verification of the lamp circuit board and more accurate positioning of the lamp circuit board without the need to wedge the circuit board into a slot.

BRIEF DESCRIPTION OF THE FIGURES

Features and advantages of the claimed subject matter will be apparent from the following detailed description of embodiments consistent therewith, which description should be considered with reference to the accompanying drawings, wherein:

DETAILED DESCRIPTION OF PREFERRED EMBODIMENTS INCLUDING BEST MODE FOR CARRYING OUT

The embodiments provide a lamp reflector assembly 10 suitable as a vehicle lamp. The embodiment disclosed below concerns a vehicle tail lamp; however, the other embodiments are not limited to vehicle lamps.

Figure 1:
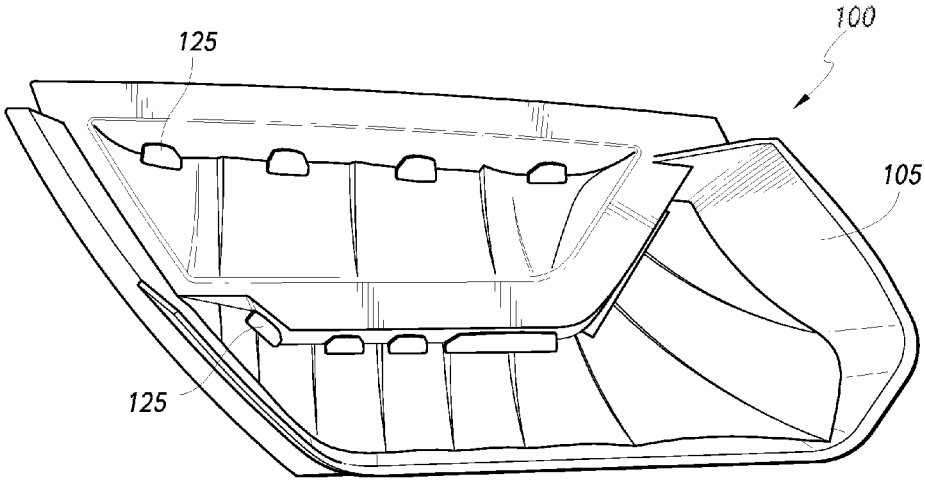
FIG. 1 is an front view of a lamp reflector.
Figure 2:
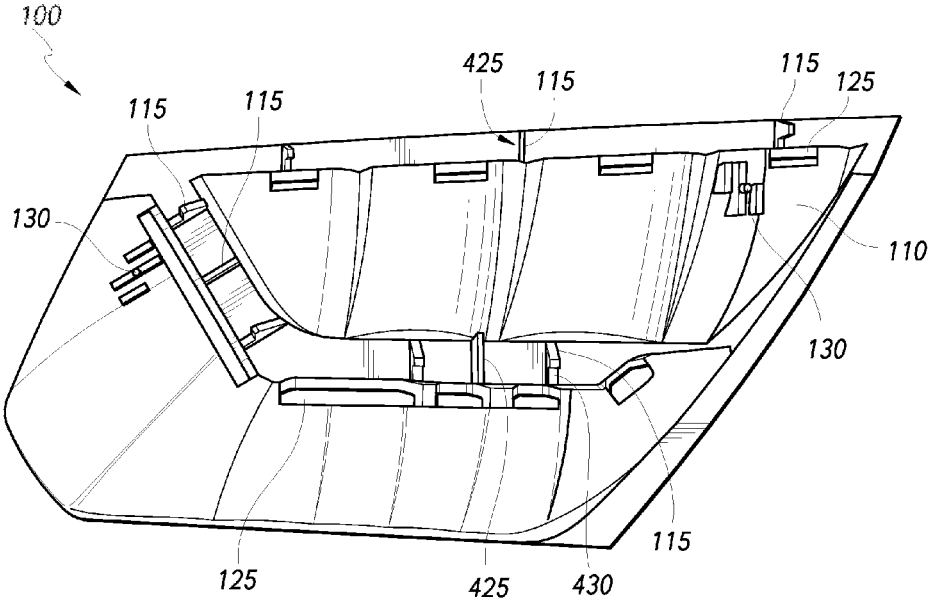
FIG. 2 is an rear view of the lamp reflector.
Figure 3:
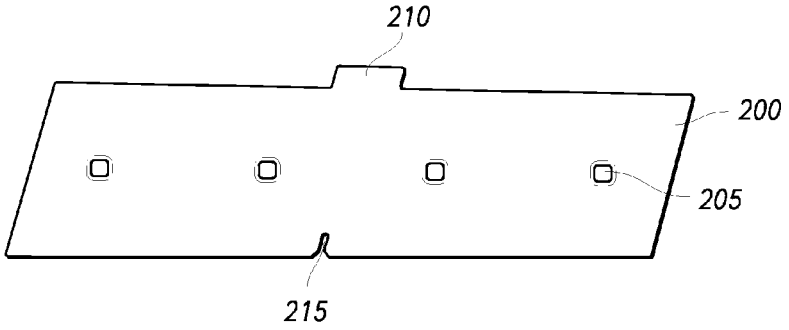
FIGS. 3-5 show lamp circuit boards.
Figure 4:
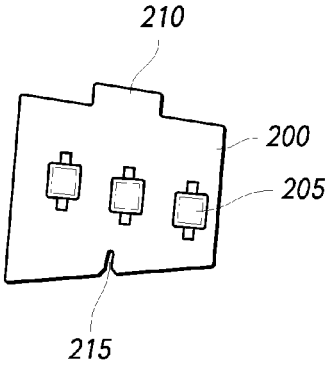
Figure 5:
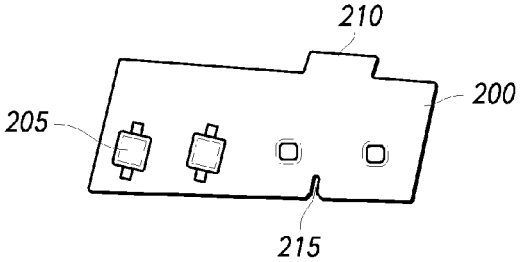

A lamp reflector 100 includes a front face 105 defining a reflective front surface (FIG. 1) and a rear face 110 defining a rear surface (FIG. 2). Circuit board first guide ribs 115 are located on the rear face 110 of the reflector 100. FIGS. 3-5 show exemplary lamp circuit boards 200, on one of which is mounted LEDs.

Figure 6:
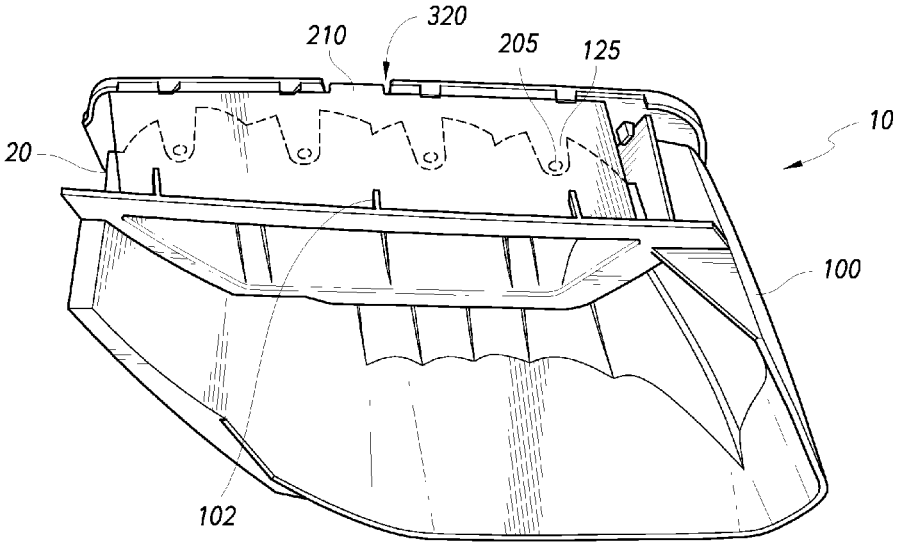
FIGS. 6-7 show the lamp reflector assembly, showing two lamp circuit boards mounted to the lamp reflector.
Figure 7:
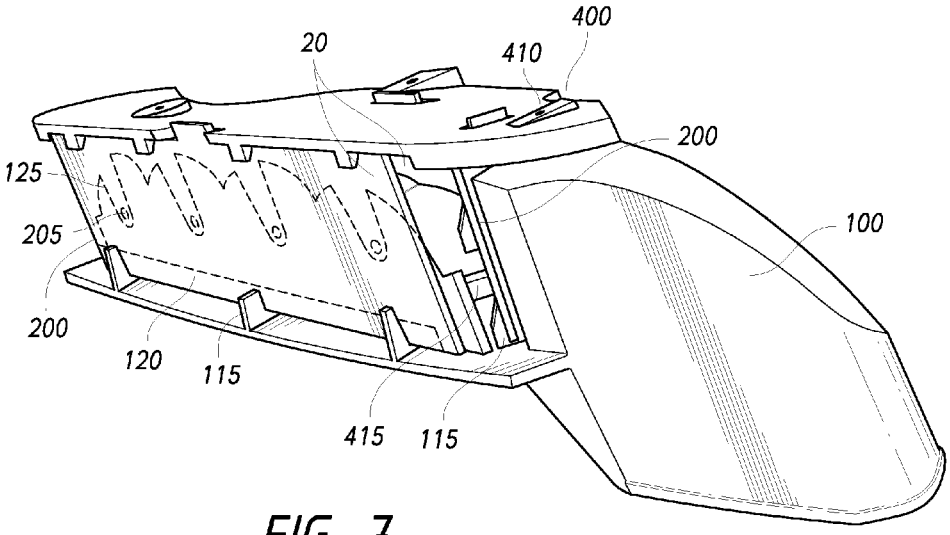

In a lamp reflector assembly 10, at least one lamp circuit board 200 is mounted to the first guide ribs 115 on the rear face 110 of the reflector 100 so that the circuit board 200 is in a design X, Y, Z position 20 with respect to the reflector 100. The design X, Y, Z position is a predetermined X, Y, Z position of the circuit board with respect to the rear face 110 of the reflector 100. FIG. 6 shows the lamp reflector assembly 10, showing two of the lamp circuit boards 200 mounted to the lamp reflector 100, as viewed from the front face of the lamp reflector 100. FIG. 7 is an enlarged portion, from slightly different angle, of the upper, right portion of FIG. 6. In preferred embodiments, each reflector rear surface 110 is surrounded by three circuit boards 200, each arranged generally along a principal major side of the reflector 100.

Figure 8:
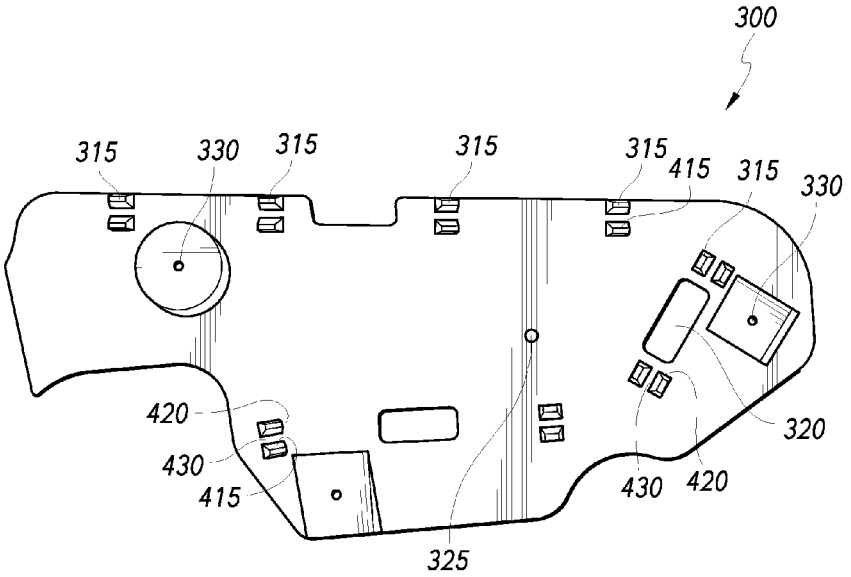
FIGS. 8-9 show inside and outside views of a circuit board holder plate.
Figure 9:
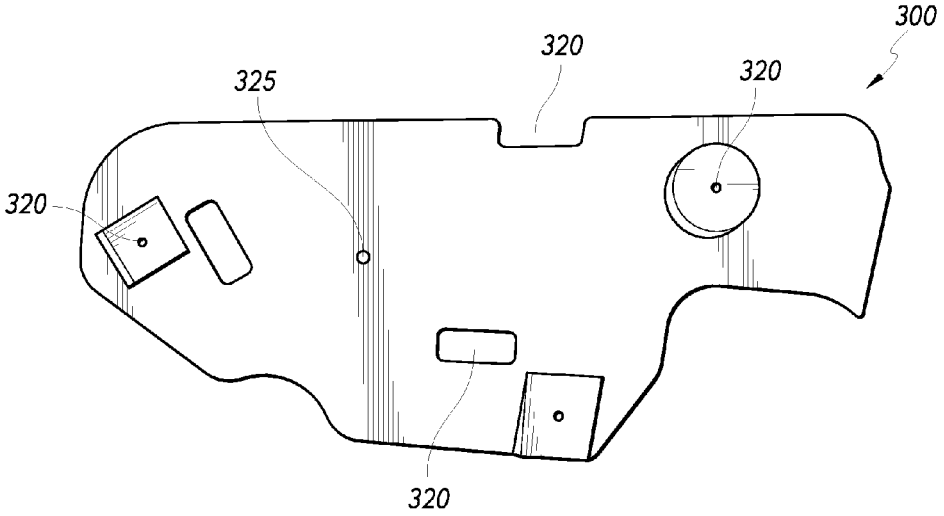

A circuit board holder plate 300, secured to reflector 100, holds the mounted circuit board 200 in the design X, Y, Z position 20 with respect to reflector 100. FIGS. 8-9 show inside and outside views of a circuit board holder plate 300. Board holder plate 300 includes circuit board second guide ribs 315 and finger slots 320. Second guide ribs 315 are grouped in pairs spaced apart a width of circuit board 200 to receive it therebetween. As seen in FIG. 8, board holder plate 300 hold three circuit boards in three different linear slots defined preferably by sets of co-linear arranged pairs of second guide ribs 315. Finger slots 320 are located within an interior of circuit board holder plate 300 or along a perimeter of circuit board holder plate 300, e.g. FIG. 9. The circuit board holder plate 300 is generally plate-like or flat. Finger slots 320 serve as receiving apertures. Accordingly, finger slots 320 may be in the form of close-sided holes, castellations, or indents along the edges of circuit board holder plate 300, as appropriate for any given embodiment.

The lamp circuit board 200, itself made of conventional material such as an FR4 board, includes one of more solid-state light elements 205 positioned thereon. The light element(s) 205 may be a light emitting diode(s) (LEDs), although other solid-state light elements 205 may be provided.

The lamp reflector 100 further includes one or more slotted holes 125 (apertures). The slotted holes 125 are positioned so that when the circuit board 200 is fixedly mounted to the reflector 100, a corresponding one of the light elements 205 is located adjacent the slotted hole 125, and in registration therewith, so that light emitted from the corresponding light element 205 passes through the slotted hole 125 to thereby illuminate the reflective front surface. FIGS. 6-7 show the slotted holes 125 and the light elements 205 in dashed lines, the light elements 205 each located adjacent a corresponding one of the slotted holes 125, and in registration therewith, so that light emitted from the light elements 205 pass through the slotted holes 125 to thereby illuminate the reflective front surface.

In a method of assembling the lamp reflector assembly 10, with the reflector front face 105 placed down, the rear surface 110 and first guide ribs 115 are exposed to an operator as shown in FIG. 2.

The operator first places the lamp circuit board 200 into first guide ribs 115. Multiple lamp circuit boards 200, for example three, are placed around the rear face 110 periphery of reflector 100. It is optionally preferred that for each reflector 100, at least one (preferably only one) circuit board 200 bear LEDs, and that the other two circuit boards 200 do not bear LEDs but carry driver electronics.

The operator second mounts the board holder plate 300 to the reflector 100 with the placed lamp circuit board 200 engaged into the second guide ribs 315 as shown in FIGS. 6-7. Mounting the board holder plate 300 to the reflector 100 fixedly mounts the circuit board 200 in the design/predetermined X, Y, Z position 20 with respect to the rear face 110 of the reflector 100. The use of board holder plate 300 is especially advantageous to locate multiple circuit boards 200 around the somewhat sloping, convex or humped lateral sides of the rear face 110 of reflective portion 105 since while the circuit boards 200 are spatially separated from one another and aligned along different planes, e.g. parallel or intersecting planes, the board holder plate 300 tends to act as a cap to capture all the so-placed circuit boards 200 prior to final fixation (such as heat staking) and counteract a tendency of the circuit boards 200 to misalign.

Placing a securing element 400 with respect to the board holder plate 300 and reflector 100 secures the mounted circuit board(s) 200 in the design X, Y, Z position 20 with respect to the rear face 110 of the reflector 100. The securing element may be, e.g., a weld 410 welding the board holder plate 300 and the reflector 100 together, a screw 405 passing through a screw hole 325 in the board holder plate 300 and into the reflector 100, or any suitable element that secures the board holder plate 300 and the reflector 100 together, or combination thereof.

In one embodiment, the reflector 100 comprises heat stake tabs 130 extending from the rear face 110; and the board holder plate 300 comprises tab holes 330 positioned to receive the stake tabs 130 therethrough when the board holder plate 300 is mounted to the reflector 100. In this position, the heat stake tabs 130 may be utilized in providing a weld 410 that secures the board holder plate 300 and the reflector 100 together.

Using the finger slots 320, and prior to securing the board holder plate 300 to the reflector 100, e.g., by heat staking, the operator performs visual position verification of the circuit board(s) 200 with respect to the reflector 100 and alignment of the circuit board(s) 200 so that the upwardly facing edges of the circuit board(s) 200 are received in the second guide ribs 315 of the board holder plate 300 and the reflector's heat stake tabs 130 align with the board holder plate's tab holes 330.

Optionally, board holder plate 300 is transparent, thereby facilitating the operator to see the placement of the lamp circuit board 200 in the first and second guide ribs 115, 315. The circuit board holder plate 300 being generally plate-like or flat further helps realignment and ease of any pick-and-place operation used in assembly.

Optionally, each embodiment may have one or more finger slots 320. When present, the finger slots 320 allow the operator to easily move and re-orient the lamp circuit board 200 with respect to the first and second guide ribs 115, 315 to thereby ensure proper seating of the lamp circuit board 200 in the first and second guide ribs 115, 315 as well as locating the lamp circuit board 200 in the correct predetermined X, Y, Z position 20 with respect to the rear face 110 of the reflector 100, with each light element 205 positioned adjacent to a corresponding slotted hole 125 so that light emitted from the each light element 205 passes through the corresponding slotted hole 125 to thereby illuminate the reflective front surface 105 of the reflector 100.

Figure 10:
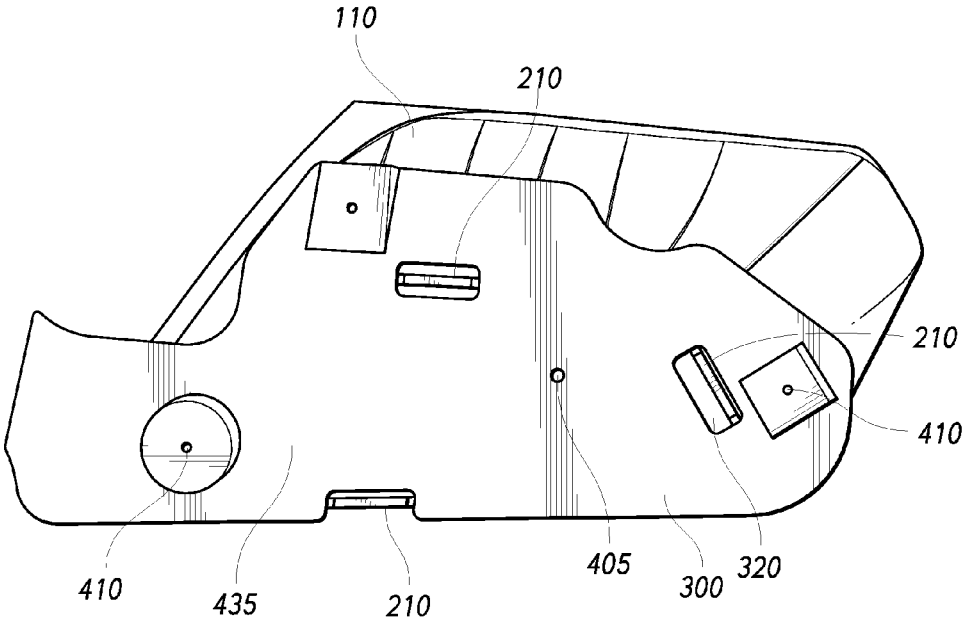
FIG. 10 shows the lamp reflector assembly from a rear view.

In preferred embodiments, the lamp circuit board 200 includes a tab 210, e.g., a finger tab 210, projecting from one perimeter edge of the lamp circuit board 200. When the lamp circuit boards 200 are mounted to the reflector 100 and the board holder plate 300 placed atop, the finger tab 210 of each respective circuit board 200 extends into, or preferably through, a respective finger slot 320 of the board holder plate 300 to be grasped for manipulation of the circuit board 200. Most preferably when in situ, finger tab 210 extends through the thickness of board holder plate 300 and exits proud of the rear surface thereof. As shown in FIG. 10, the finger tab 210 extends through the finger slot 320 with slight clearance. Thus, if parts are misaligned, then from the standpoint of each circuit board 200, slight displacement of the finger tab 210 allows proper alignment of each lamp circuit board 200, the board holder plate 300, and the lamp reflector 100 parts relative to each other. For example, slight displacement of the finger tab 210 of each circuit board 200 allows that board to push against the board holder plate 300 so that if the finger tab 210 is slightly misaligned relative the tab holes 330, this can be corrected. Alternatively, or in addition thereto, slight displacement of the finger tab 210 allows a possible misalignment between an edge of the circuit board 200 and either the reflector's first guide rib 115 or the board holder plate's second guide rib 315 during placement of parts, but before heat staking, to be corrected. These protruding finger tabs 210 further define regions where electrical connectors can be located on the circuit boards 200.

FIG. 10 shows the lamp reflector assembly 10 from a rear view with the reflector rear surface 110 surrounded by three circuit boards 200 (one of which carries LEDs), each arranged generally along the principal major side of the reflector 100.

Advantageously, either one or both of the first and second guide ribs 115, 315 have a shape that forces the mounted circuit board toward the rear face 110 of the reflector 100. The shape may include an inclined surface 415 that will bear on a rear face of the mounted circuit board 200, thereby forcing the mounted circuit board 200 towards the rear face 110 of the reflector 100. Alternatively, the guide ribs 115, 315 themselves may by inclined 420, extending at an angle relative to a mounting surface of the reflector 100 or holder plate 300 to thereby force the mounted circuit board 200 towards the rear face 110 of the reflector 100. In one embodiment, the first guide ribs 115 may be inclined three (3) degrees away from the reflector part's die pull direction in the case of an injection molded reflector 100, typically molded from a heat-resistant thermoset plastic compound.

The first guide ribs 115 alone may have the shape that forces the mounted circuit board 200 toward the rear face 110 of the reflector 100. The second guide ribs 315 alone may have the shape that forces the mounted circuit board 200 toward the rear face 110 of the reflector 100.

Advantageously, either one or both of the first and second guide ribs 115, 315 comprises a locator rib 425. The locator rib 425 engages the mounted circuit board 200 to thereby locate a position of the circuit board 200 laterally with respect to the rear face 110 of the reflector 100. The first guide ribs 115 alone may comprise the locator rib 425. The second guide ribs 325 alone may comprise the locator rib 425.

Advantageously, the lamp circuit board 200 includes a notch 215 extending into a perimeter edge of the lamp circuit board 200. The notch 215 engages with the locator rib 425 to locate the position of the circuit board 200 laterally with respect to the rear face 110 of the reflector 100.

Embodiments include plural lamp circuit boards 200 located by each circuit board holder plates 300, each board holder plate fixedly corresponding lamp circuit boards 200 in a corresponding predetermined X, Y, Z position 20 with respect to the rear face of the reflector 100, with each light element 205 of each lamp circuit board 200 positioned adjacent to a corresponding one of the slotted holes 125 so that light emitted from the each light element 205 passes through the corresponding slotted hole 125 to thereby illuminate the reflective front surface 105 of the reflector 100.

Advantageously, the rear face 110 of the circuit board holder plate 300 further comprises a driver board surface area 435 for attaching a driver board to the rear face of circuit board holder plate 300 at the driver board surface area 435. Electrical connections may extend between the driver board and each lamp circuit board(s) 200.

As shown in FIGS. 6-7, the circuit board first guide ribs 115 are positioned on a portion of rear face 110 of reflector 100 to hold circuit board holder plate 300 approximately orthogonally to an adjacent portion of rear face 110 of the reflector 100. However, circuit board first guide ribs 115 may be positioned to hold the circuit board holder plate 300 non-orthogonally to the portion of rear face 110 of the reflector 100.

The first guide ribs 115 of the reflector 100 are of any form suitable for receiving the lamp circuit and, in conjunction with the second guide ribs 315 of the circuit board holder plate 300, fixedly mounting the lamp circuit board 200 in the design predetermined X, Y, Z position 20 with respect to the rear face 110 of the reflector 100.

As shown in FIG. 8, each of the first and second guide ribs 115, 315 may, e.g., comprise at least one projecting first rib element located adjacently another guide element (e.g. a projecting second rib element) such that a lamp circuit board receiving space 430 is defined therebetween. For the first guide ribs 115, the another guide element 120 may a continuous part of the reflector extending between plural first rib elements and spaced apart therefrom (FIG. 7). The first and second rib elements 115, 315 may project from a local surface orthogonally or non-orthogonally.

While several embodiments of the present disclosure are described and illustrated herein, those of ordinary skill in the art will readily envision other means and/or structures for performing the functions and/or obtaining the results and/or one or more of the advantages described herein, and each such variation and/or modification is deemed within the scope of the present disclosure. All parameters, materials, and configurations described herein are exemplary and the actual parameters, materials, and/or configurations will depend upon the specific application for which the teachings of the present disclosure are used. Those skilled in the art will recognize, or be able to ascertain using no more than routine experimentation, many equivalents to the specific embodiments described herein. It is therefore understood that the foregoing embodiments are presented by way of example and that, within the scope of the appended claims and equivalents thereto, the disclosure may be practiced otherwise than as specifically described and claimed. The present disclosure is directed to each individual feature, system, kit, and/or method described herein. In addition, any combination of two or more such features, systems, kits, and/or methods, if such are not mutually inconsistent, is within the scope of the present disclosure.

All definitions, as defined and used herein, should be understood to control over dictionary definitions, definitions in documents incorporated by reference, and/or ordinary meanings of the defined terms.

The indefinite articles "a" and "an" as used herein in the specification and in the claims, unless clearly indicated to the contrary, are understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

The following lists reference numeral used herein:

10 lamp reflector assembly
20 design X, Y, Z position
100 lamp reflector
105 front face defining a reflective front surface
110 rear face defining a rear surface
115 first guide rib
120 another guide element
125 slotted holes
130 heat stake tab
200 lamp circuit board
205 solid-state light element
210 finger tab
215 notch
300 circuit board holder plate
315 second guide rib
320 finger slot
325 screw hole
330 tab holes
400 securing element
405 screw
410 weld
415 inclined surface
420 inclined rib
425 locator rib
430 lamp circuit board receiving space
435 driver board surface area

We claim:

1. A lamp reflector assembly, comprising:

a plurality of lamp circuit boards, said plurality of lamp circuit boards having one or more solid-state light elements positioned thereon;

a lamp reflector having a plurality of wall surfaces having a front face defining a reflective front surface and a rear face defining a rear surface, said lamp reflector including a plurality of circuit board first guide ribs, located on said rear face, and said plurality of wall surfaces having one or more apertures through which light rays pass; and a circuit board holder plate having a plurality of second guide ribs, said circuit board holder plate being secured to said lamp reflector;

wherein said plurality of circuit board first guide ribs of said lamp reflector and said plurality of second guide ribs of said circuit board holder plate adapted to support said plurality of lamp circuit boards in a generally perpendicular position between said lamp reflector and said circuit board holder plate and in a predetermined position with respect to said plurality of wall surfaces, respectively, so that each said solid-state light element is positioned adjacent to a corresponding said one or more apertures so that light emitted from each of said one or more solid-state light element passes through said corresponding one or more apertures to thereby illuminate said reflective front surface of said lamp reflector, said plurality of circuit board first guide ribs and said plurality of second guide ribs support said plurality of lamp circuit boards in a generally perpendicular position between said lamp reflector and said circuit board holder plate;

said plurality of lamp circuit boards being captured between said plurality of circuit board first guide ribs and said plurality of second guide ribs in order to support said plurality of lamp circuit boards between said circuit board holder plate and said rear surface of said lamp reflector and to secure said plurality of lamp circuit boards in said predetermined position in said lamp reflector assembly; and wherein said plurality of second guide ribs cooperate to define a receiving aperture for receiving said plurality of lamp circuit boards, said circuit board holder plate further comprising at least one slot and said plurality of lamp circuit boards having a tab that is received in said at least one slot to facilitate alignment of said plurality of lamp circuit boards relative to said one or more apertures so that said light rays from said one or more solid-state light elements passes through said corresponding one or more apertures to thereby illuminate said reflective front surface of said lamp reflector;

wherein said lamp reflector is concave and comprising said plurality of wall surfaces, said plurality of circuit board first guide ribs cooperating with said plurality of second guide ribs to support said plurality of lamp circuit boards between said lamp reflector and said circuit board holder plate and to support said plurality of lamp circuit boards in different planes in said lamp reflector wherein said plurality of lamp circuit boards are generally planar and each comprises a longitudinal surface for supporting said one or more solid-state light elements, wherein said longitudinal surfaces of said plurality of lamp circuit boards lie in said different planes.

2. The lamp reflector assembly of claim 1, wherein at least one of said plurality of circuit board first guide ribs and said plurality of second guide ribs has a shape forcing a mounted circuit board toward said rear face of said lamp reflector, said shape comprising an inclined surface that will bear on a rear face of said mounted circuit board thereby forcing said mounted circuit board towards said rear face of said lamp reflector.

3. The lamp reflector assembly of claim 2, wherein at least said plurality of circuit board first guide ribs has said shape forcing said mounted circuit board toward said rear face of said lamp reflector.

4. The lamp reflector assembly of claim 2, wherein at least said plurality of second guide ribs has the shape forcing said mounted circuit board toward said rear face of said lamp reflector.

5. The lamp reflector assembly of claim 2, wherein both said plurality of circuit board first guide ribs and said plurality of second guide ribs have said shape forcing said mounted circuit board toward said rear face of said lamp reflector.

6. The lamp reflector assembly of claim 2, wherein at least one of said plurality of circuit board first guide ribs and said plurality of second guide ribs comprises a locator rib, said locator rib engaging said mounted circuit board to thereby locate a position of said mounted circuit board laterally with respect to said rear face of said lamp reflector.

7. The lamp reflector assembly of claim 6, wherein said at least one of said plurality of circuit board first guide ribs comprises said locator rib.

8. The lamp reflector assembly of claim 6, wherein said plurality of second guide ribs comprises said locator rib.

9. The lamp reflector assembly of claim 6, wherein both said plurality of circuit board first guide ribs and said plurality of second guide ribs comprise at least one said locator rib.

10. The lamp reflector assembly of claim 1, wherein said circuit board holder plate further comprises a finger slot; and with said plurality of lamp circuit boards mounted to said lamp reflector by said circuit board holder plate, a finger tab projecting from a perimeter edge of said plurality of lamp circuit boards extends into said finger slot of said circuit board holder plate, whereby said finger tab extending into said finger slot facilitates repositioning said plurality of lamp circuit boards being mounted in the predetermined position with respect to said rear face of said lamp reflector.

11. The lamp reflector assembly of claim 1, wherein said lamp reflector further comprises heat stake tabs extending from said rear face, said circuit board holder plate further comprises tab holes positioned to receive said heat stake tabs therethrough when said circuit board holder plate mounts said plurality of lamp circuit boards to said lamp reflector, and with said circuit board holder plate mounting said plurality of lamp circuit boards to said lamp reflector, said heat stake tabs are configured to provide a weld that secures said circuit board holder plate and said lamp reflector together.

12. The lamp reflector assembly of claim 1, wherein at least one of said plurality of circuit board first guide ribs and said plurality of second guide ribs comprises a locator rib, said locator rib engaging a mounted circuit board to thereby locate a position of said mounted circuit board laterally with respect to said rear face of said lamp reflector.

13. The lamp reflector assembly of claim 12, wherein said plurality of lamp circuit boards comprises a notch extending into a perimeter edge of said plurality of lamp circuit boards, said notch positioned to engage with said locator rib to locate the position of said plurality of lamp circuit boards laterally with respect to said rear face of said lamp reflector.

14. The lamp reflector assembly of claim 1, wherein said circuit board holder plate is transparent, thereby facilitating visual inspection of said plurality of circuit board first guide ribs and said plurality of second guide ribs mounting said plurality of lamp circuit boards in the predetermined position with respect to said rear face of said lamp reflector.

15. The lamp reflector assembly of claim 1, wherein said circuit board holder plate is generally flat.

16. The lamp reflector assembly of claim 1, wherein said circuit board holder plate fixedly mounting said plurality of lamp circuit boards to said lamp reflector.

17. A method of assembling a lamp reflector assembly, comprising:

providing a plurality of lamp circuit boards having one or more solid-state light elements positioned thereon and having at least one tab projecting from an edge of said plurality of lamp circuit boards;

providing a lamp reflector having a plurality of wall surfaces having a reflective front face, a rear surface, said lamp reflector formed with a plurality of circuit board first guide ribs on said lamp reflector rear surface, said plurality of circuit board first guide ribs formed to receive said plurality of lamp circuit boards;

placing said lamp reflector with said reflective front face down, and said rear surface and said plurality of circuit board first guide ribs exposed to an operator;

placing said plurality of lamp circuit boards into said plurality of circuit board first guide ribs;

mounting a circuit board holder plate to said lamp reflector, said circuit board holder plate being formed with a plurality of second guide ribs adapted to receive a portion of said plurality of lamp circuit boards, said circuit board holder plate further being formed with at least one slot adapted to receive a corresponding said at least one tab of said plurality of lamp circuit boards, while performing said mounting, engaging said plurality of lamp circuit boards into said plurality of second guide ribs formed on said circuit board holder plate, while performing said engaging, extending said at least one tab of said plurality of lamp circuit boards into said at least one slot of said circuit board holder plate, displacing said at least one tab of said plurality of lamp circuit boards to facilitate desired positioning of at least two elements relative one another of the group of elements consisting of said plurality of lamp circuit boards, said circuit board holder plate, and said lamp reflector; and securing said circuit board holder plate to said lamp reflector to secure said plurality of lamp circuit boards in fixedly mounted desired position on said rear face of said lamp reflector and generally perpendicular to said circuit board holder plate;

wherein said plurality of second guide ribs cooperate to define a receiving aperture for receiving said plurality of lamp circuit boards, said circuit board holder plate further comprising at least one slot and said plurality of lamp circuit boards having a tab that is received in said at least one slot to facilitate alignment of said plurality of lamp circuit boards relative to one or more apertures so that said light rays from said one or more solid-state light elements passes through said corresponding one or more apertures to thereby illuminate said reflective front surface of said lamp reflector;

wherein said lamp reflector is concave and comprising said plurality of wall surfaces, said plurality of circuit board first guide ribs cooperating with said plurality of second guide ribs to support said plurality of lamp circuit boards between said lamp reflector and said circuit board holder plate and to support said plurality of lamp circuit boards in different planes in said lamp reflector.

wherein said plurality of lamp circuit boards are generally planar and each comprises a longitudinal surface for supporting said one or more solid-state light elements, wherein said longitudinal surfaces of said plurality of lamp circuit boards lie in said different planes.

18. The method of claim 17, wherein said plurality of lamp circuit boards further comprises providing said plurality of lamp circuit boards with at least one light element thereon, said lamp reflector further comprises defining at least one slotted hole extending from said rear surface to said reflective front face for admitting light therethrough, and said plurality of lamp circuit boards further comprises positioning each said light element adjacent to said corresponding slotted hole of said lamp reflector so that light emitted from each said light element passes through said corresponding slotted hole to thereby illuminate said reflective front face of said lamp reflector.

* * * * *